United States Patent [19]

Hazard

[11] 3,977,557

[45] Aug. 31, 1976

[54] CONTAINER-CLOSURE STRUCTURE EMPLOYING FITMENT TO PREVENT CLOSURE REMOVAL

[75] Inventor: Robert E. Hazard, N. Kingstown, R.I.

[73] Assignee: Polytop Corporation, Slatersville, R.I.

[22] Filed: Oct. 15, 1975

[21] Appl. No.: 622,724

[52] U.S. Cl. ..... 215/274; 215/218; 215/330; 220/319; 222/153

[51] Int. Cl.[2] ..... B65D 45/32

[58] Field of Search ..... 215/9, 216, 7, 218, 215/330, 336, 221, 274; 220/319, 288; 222/153, 182

[56] References Cited

UNITED STATES PATENTS

| | | | |
|---|---|---|---|
| 3,881,623 | 5/1975 | Landen | 215/216 |
| 3,892,326 | 7/1975 | Schneible | 222/153 X |
| 3,905,509 | 9/1975 | Markowitz | 220/319 |

*Primary Examiner*—George T. Hall
*Attorney, Agent, or Firm*—Edward D. O'Brian

[57] ABSTRACT

A conventional, relatively soft plastic bottle having a generally cylindrical threaded container neck such as a common polyethylene bottle may be used with a specially formed closure and a fitment as a child resistant container. The closure includes internal ratchets adjacent to the bottom of the skirt which are adapted to coact with corresponding ratchets on the fitment so as to prevent the closure from being unthreaded from the container neck. The fitment engages the container and/or the container neck in such a manner as to lock the fitment against rotation. Preferably the fitment is formed so that it can be moved along the container neck to an operative position in which there is such engagement with the container and/or container neck as the closure is threaded on the container neck.

5 Claims, 7 Drawing Figures

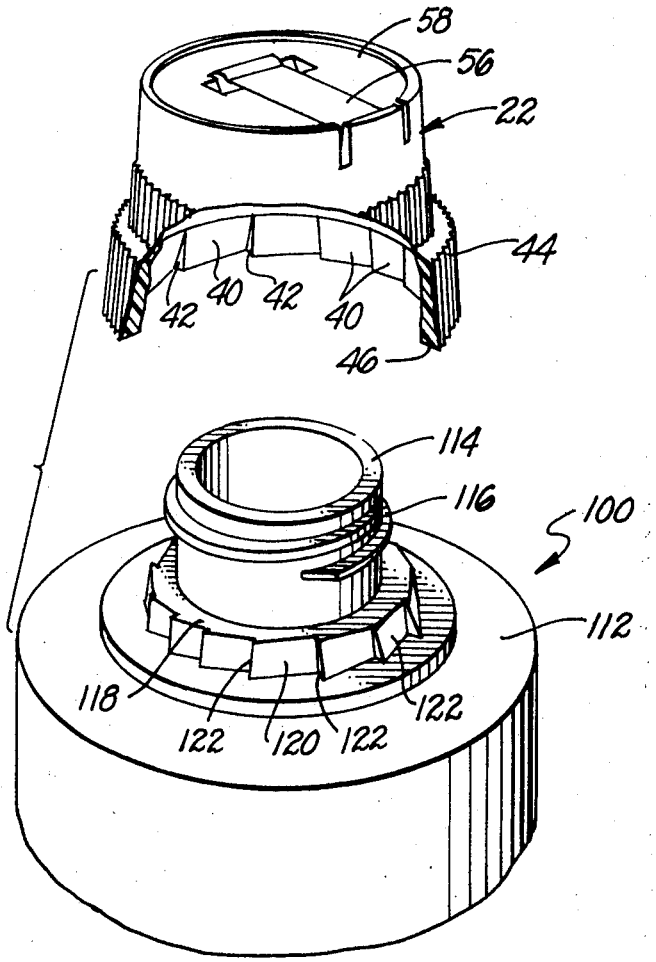
FIG. 7.
FIG. 6.
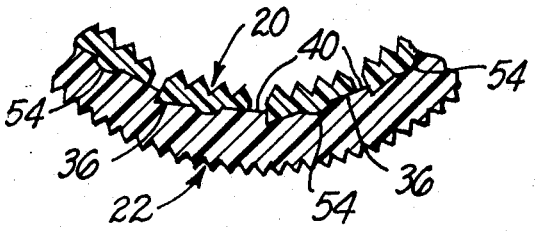

CONTAINER-CLOSURE STRUCTURE EMPLOYING FITMENT TO PREVENT CLOSURE REMOVAL

BACKGROUND OF THE INVENTION

The invention set forth in this specification pertains to new and improved container-closure structures. More specifically it pertains to such structures in which a small ring-like part or fitment serves to prevent the removal of the closure from the container.

The increasing recognition of the need and/or desirability of packaging various materials in containers of a "child-resistant" character has created many problems in the packaging field. Generally speaking a closure for use on a container is considered to be child-resistant in character when such a closure can be opened by most adults but cannot be opened by most comparatively young children. In many instances the need for child-resistant containers and closures is being met by providing specialized containers and/or closures. From an economic standpoint this tends to be undesirable because of the costs involved in providing new molds, dies, tools and/or the like and because frequently such specialized child-resistant structures are of such a character as to require new types of assembly equipment.

As an example of this it has been proposed to modify both conventional containers and conventional closures to provide cooperating ratchet members so that such containers and closures can be utilized together in providing child-resistant container-closure structures. Such expedients are considered disadvantageous because they involve modifying the tooling for both the container and the closure used and/or making new tooling for producing both a container and a closure. Obviously it would be desirable from an economic standpoint to utilize known containers of a non-child resistant character in providing child-resistant packaging so as to avoid the costs attendant to either modify existing molds and/or dies or to create new molds and/or dies.

BRIEF SUMMARY OF THE INVENTION

A basic objective of the present invention is to provide a way in which certain types of common, existing non-child-resistant type containers may be utilized so as to obtain a container-closure structure which is of a child-resistant character. Other objectives of the present invention are to provide container-closure structures utilizing a ring or fitment serving to secure the closure structure to the container in such a manner that the combination of parts is of a child-resistant character. Further objects of the present invention are to provide closures and fitments as herein indicated which can be manufactured at a comparatively nominal cost, which can be easily and conveniently installed on existing, conventional containers with a minimum of difficulty—frequently through the use of existing capping equipment—and which are very effective in obtaining a complete package of a child-resistant character.

In accordance with this invention these and various other related objectives of the invention as will be apparent from the remainder of this specification are achieved in the combination of a container having a generally cylindrical, externally threaded neck and a closure having an internally threaded skirt, this closure being threaded on the neck, by the improvement which comprises: a plurality of closure ratchet means for permitting rotation in one direction or preventing rotation in the opposite direction, these closure ratchet means being located on the skirt, a ring located around the neck adjacent to the skirt, a plurality of ring ratchet means for permitting rotation in one direction and for preventing rotation in the opposite direction, these ring ratchet means being located on the ring and being in contact with the closure ratchet means, these closure and ring ratchet means being oriented relative to one another and to the threads on the neck and the skirt so as to permit the closure to be threaded down on the neck and so as to prevent the closure from being unthreaded from the neck when the ring is held against rotation, and holding means for engaging the container so as to prevent rotation of the ring, such holding means being located on the ring and engaging the container.

Preferably an improved structure in accordance with this invention involves various features as are indicated by the remainder of this specification in addition to those indicated in the preceding. In the preferred manner of practicing the invention the ring, the ring ratchet means and the holding means are all formed as a unitary part or fitment out of a material which is harder than the material utilized in the container and/or the container neck so as to permit effective engagement of the holding means with the container. In accordance with the concepts of this invention the ratchet means on the closure skirt and on such a fitment are preferably sloped as hereinafter described so that the closure itself urges the holding means employed into effective engagement with the container in such a manner that the closure cannot be unscrewed from the container neck.

BRIEF DESCRIPTION OF THE DRAWINGS

The invention is best more fully explained with reference to the accompanying drawings in which:

FIG. 6 is a view similar to FIG. 2 of a further modification which may be made in the parts illustrated in the preceding figures;

FIG. 7 is a view corresponding to FIG. 1 illustrating how a closure as illustrated in the preceding figures can be utilized with a specially formed container.

Figure 1:
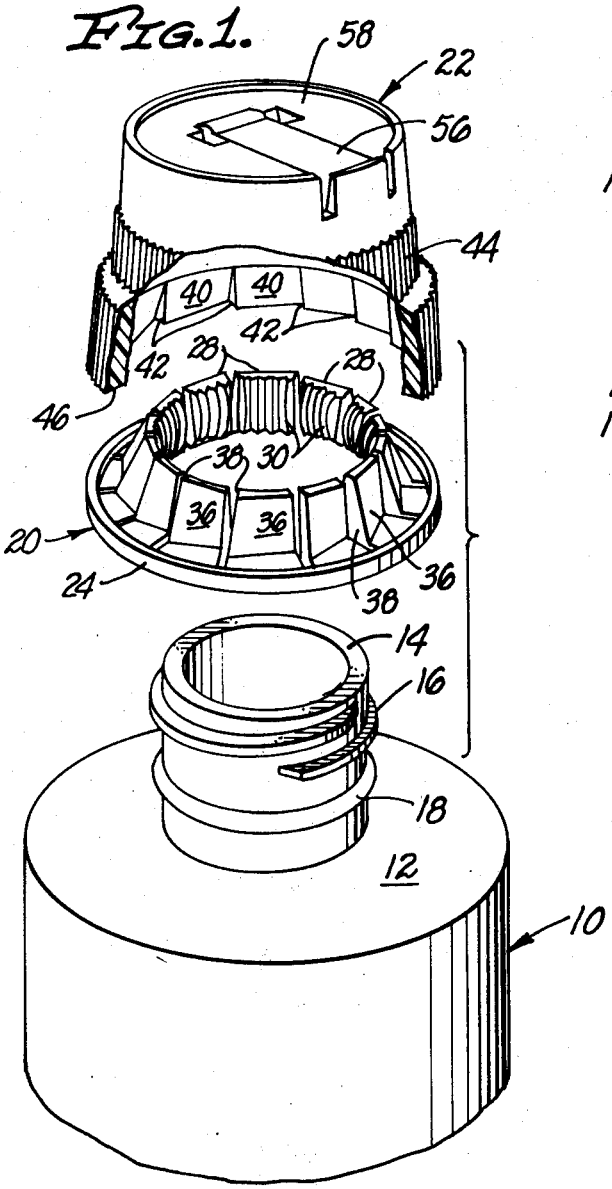
FIG. 1 is an exploded isometric view of a conventional container as used in combination with a presently preferred fitment and closure in accordance with the concepts of this invention in which part of the closure has been broken away to show its internal structure.

The particular structures illustrated in the drawings utilize certain essentially intangible concepts or principles as are set forth and defined in the appended claims. It is to be realized that these concepts or principles can be utilized in a number of other somewhat differently appearing and somewhat differently constructed structures through the use or exercise of routine engineering skill.

DETAILED DESCRIPTION

In the drawings there is shown a conventional container 10 which is preferably formed out of a relatively soft, deformable material such as common polyethylene as used for blow molding. It is considered desirable with the invention for the container 10 to be manufactured out of such a polymer material which will tend to "creep" or deform when held under compression for a prolonged period. This container 10 has a container top 12 from which there extends a generally cylindrical neck 14 provided with an external thread 16 and an external bead 18 extending completely around the neck 14 in a plane perpendicular to the axis of this neck 14.

This container 10 is used in conjunction with a fitment 20 and a closure 22. The fitment 20 is preferably formed as an integral part or unit of a material which is harder than and more resistant to deformation than the material used in the container 10. It is presently considered that satisfactory results can be achieved if the fitment 20 is manufactured out of a material such as a conventional injection molding grade of polypropylene when the container 10 is formed out of softer polyethylene as indicated in the preceding.

This fitment 20 includes a ring 24 which is adapted to fit around the neck 14 against the top 12 of the container 10. This ring 24 carries a plurality of inwardly extending ratchet fingers 26. These fingers 26 are separate from one another and are all identically formed so as to include upstanding walls 28 which extend in a cylindrical path (not numbered) around the neck 14. This path is slightly larger than the neck 14 of the container 10. These walls 28 carry inwardly extending, vertically oriented, relatively sharp ridges 30 which are adapted to engage the bead 18 as the fitment 20 is used. Because of the resiliency of the connections 32 of the fingers 26 with the ring 24 these fingers 26 are capable of flexing outwardly during the installation of a fitment 20 so as to pass over the thread 16 and so as to partially pass over the bead 18.

These connections 32 consist of comparatively thin areas of material which are capable of temporary deformation so as to act more or less like hinges. Sloping surfaces 34 may be provided on the walls 28 and the ridges 30 so as to facilitate temporary deformation of the fingers 26 inwardly as the fitment 20 is being moved along the neck 14 toward the top 12. If desired various of the fingers 26 may be omitted from the fitment 20 provided enough of these fingers 26 are utilized so that a firm holding action is achieved as the fitment 20 described is installed and used. When various fingers 26 are omitted the fitment 20 should retain fingers 26 which are equally spaced from one another around the interior of the ring 24.

The various individual fingers 26 are each shaped so as to include sloping surfaces 36 separated by radial surfaces 38 at approximately right angles to these surfaces 36. These sloping surfaces 36 are preferably substantially flat surfaces located so as to extend more or less tangentially about the axis (not shown) of the ring 24 and so as to tend to converge inwardly away from the ring 24. These surfaces 36 and 38 define what may be considered as ratchets or ratchet means on the ring 24. The surfaces 36 are sloped as shown so as to extend inwardly from the ring 24 toward the top of the neck 14 when the fitment 20 is installed in an operative position as described.

When the surfaces 36 and 38 are shaped as shown they are adapted to cooperate with corresponding sloping surfaces 40 and corresponding radial surfaces 42 located within the interior of a skirt 44 forming a part of the closure 22. These surfaces 40 and 42 may also be considered as ratchets or ratchet means. The surfaces 36 and 40 are of such a configuration that they will abut against one another during the assembly of the closure 22 upon the neck 14 so as to provide force components which will tend to drive or move the fitment 20 downwardly until contact with the bottom 46 of the skirt 44 will push the ring 24 into engagement with the top 12.

When the ring 24 reaches this position the surfaces 36 and 40 will tend to slide against one another so as to act as cams or in a cam like manner in order to wedge the fingers 26 inwardly to such an extent that the ridges 30 will tend to bite into and engage the bead 18. If this bead 18 is omitted for any reason the ridges 30 will bite into and engage the neck 14 of the container 10 and/or any thread such as the thread 16 extending along the neck 14 so as to be opposite these ridges 30. An effective interaction will be achieved between the bead 18 and the ridges 30 because of the difference of the hardnesses of materials in the ridges 30 and in the container 10.

This interaction will, in effect, create significant compression between the fingers 26 and the neck 14 which will be maintained as long as no effort is made to remove the closure 22 from the neck 14. The forces exhibited in this manner will tend to cause the material within the neck 14 to cold flow after a reasonable period of time normally approximating the time interval after a closure is assembled on a container until the complete package of such a container and closure reaches an ultimate sales or user location. As a result of such cold flow the ridges 30 will exercise an effective holding action so as to secure the fitment 20 against rotation relative to the neck 14. However, it is to be noted that there will be a holding action achieved even prior to such cold flow occuring as a result of the action of the surfaces 40 tending to force the individual fingers 26 inwardly.

If desired, it is possible to locate on the ring 24 a plurality of auxiliary ridges 48 which will engage the top 12 as the closure 22 is employed to force the fitment 20 downwardly. Such ridges 48 will tend to bite into or engage the top 12 in such a manner as to hold the fitment 20 against rotation. After a time interval during which the ridges 48 are held in contact with the top 12 there will also be cold flow of the top 12 which will tend to further secure the fitment 20 against rotation.

Figure 2:
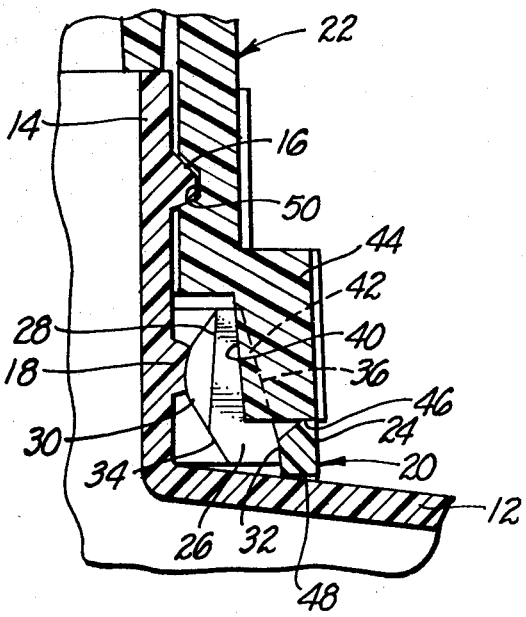
FIG. 2 is a partial cross-sectional view at an enlarged scale showing a part of the container, the fitment and the closure illustrated in FIG. 1 installed together in a child-resistant container-closure structure.
Figure 3:
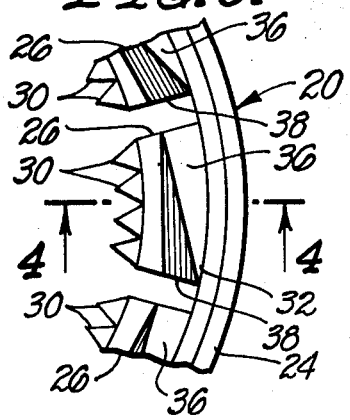
FIG. 3 is a partial top elevational view of the fitment indicated in the preceding figures.

It is believed that the assembly of the closure 22 upon the container 10 in accordance with this invention will be reasonably obvious from the aforegoing description. Prior to the closure 22 being assembled on the neck 14 the fitment 20 will be placed over this neck 14. As a thread 50 of the skirt 44 is caused to engage the thread 16 and as the closure 22 is rotated upon the neck 14 both the closure 22 and the fitment 20 will move generally toward the top 12 until such time as both the fitment 20 and the closure 22 assume operative positions as indicated in FIG. 2. Such assembly normally may be carried out using a conventional capping machine.

Once the fitment 20 and the closure 22 are in an operative position any effort made to twist the closure 22 off the neck 14 will bring the surfaces 38 and 42 into engagement with one another and this will block the closure 22 from being rotated so that it can be removed from the container 10. Obviously the more complete the engagement between the fitment 20 and the container 10 the more resistant the structure will be to removal of the closure 22. Because the sloping surfaces 36 and 40 will normally tend to slide over one another as the closure 22 is being assembled a reasonably effective holding action will be achieved prior to any significant cold flow of the container 10 being apparent.

Figure 5:
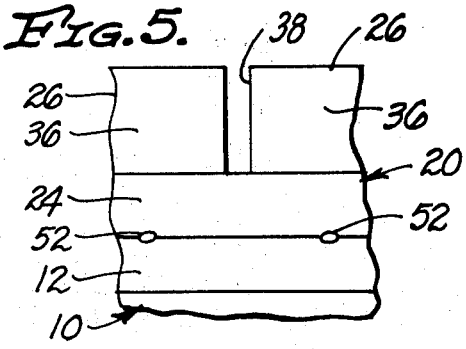
FIG. 5 is a view similar to FIG. 2 of a modification which may be made in the parts illustrated in the preceding figures.
Figure 4:
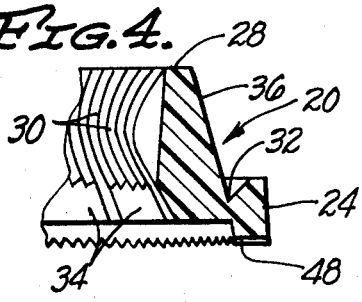
FIG. 4 is a partial cross-sectional view taken at line 4—4 of FIG. 3.

In FIGS. 5 and 6 of the drawings there are shown modified structures which are quite similar to the structures shown in the preceding four figures. In the interest of brevity the same numerals used in the preceding to designate various parts are used to designate such parts in FIGS. 5 and 6 and such parts are not separately described herein.

FIG. 5 is intended to illustrate that the fitment 20 may be secured to the closure 22 so that both the fitment 20 and the closure 22 may be handled as a unit as they are being installed on a container 10. In FIG. 5 small weld areas 52 equally spaced from one another are located around the peripheries of the bottom 46 and of the ring 24 so as to temporarily connect the closure 22 to the fitment 20. These areas 52 are sufficiently small so as to be capable of being easily broken as the closure 22 is torqued down in a final operative position upon the neck 14 so as to permit the surfaces 36 and 40 to slide with respect to one another so as to exert effective compression upon the fingers 26.

FIG. 6 is intended to illustrate that the fitment 20 and the closure 22 may be temporarily secured together so as to be handled as a unit through the use of coacting detent bumps and depressions 54 located upon the surfaces 36 and 40. This type of a detent structure will releasably hold the fitment 20 upon the closure 22 in such a manner as to permit the type of action described in the preceding.

One significant advantage of the present invention is that closures such as the closure 22 can, if desired, be utilized upon specially formed containers as well as with fitments and conventional containers as indicated in the preceding discussion. This is indicated in FIG. 7 where there is shown a closure 22 corresponding to the closure 22 previously described. In the interest of brevity various parts of the closure 22 shown in FIG. 7 are not separately described herein and are indicated both in this specification and in the drawing by the numerals previously used to designate such parts.

This closure 22 shown in FIG. 7 is intended to be utilized with a container 100 corresponding to the container 10 and formed out of material such as is used in forming the container 10. This container 10 includes a top 112, a neck 114, and carries a thread 116. The neck 114, however, differs from the neck 14 by including a ring 118 having external sloping and radial surfaces 120 and 122 respectively, which correspond to the surfaces 36 and 38 respectively. These surfaces 120 and 122 will act as cooperating ratchets which cooperate with the surfaces 40 and 42 in order to prevent removal of the closure 22 from the container 100.

The closure 22 illustrated and described in the preceding preferably is formed as a dispensing closure so as to include a spout 56 rotatably mounted upon the top 58 of this closure 22 in an established manner so as to be capable of being rotated between a closed position such as is shown in FIG. 1 and a vertically oriented open position in which a passage (not shown) in the spout 56 is aligned with an opening (not shown) extending through the top 58. Because of various consructions of dispensing closures that are known and because many of such closures are described in the patent literature and in use commercially it is not considered necessary to more specifically describe the operative elements of a dispensing closure to be used with the invention.

I claim:

1. In the combination of a container having a generally cylindrical, externally threaded neck of a polymer material which will tend to deform when held under compression for a prolonged period and a closure having an internally threaded skirt, said closure being threaded on said neck, the improvement which comprises:

a plurality of closure ratchet means for permitting rotation in one direction and for preventing rotation in the opposite direction, said closure ratchet means being located on said skirt, a ring formed of a material which is harder than and more resistant to deformation than said polymer material in said neck located around said neck adjacent to said skirt, a plurality of ring ratchet means for permitting rotation in one direction and preventing rotation in the opposite direction, said ring ratchet means being located on said ring and being in contact with said closure ratchet means, said closure and said ring ratchet means being oriented relative to one another and to the threads on said neck and on said skirt so as to permit said closure to be threaded down on said neck and so as to prevent said closure from being unthreaded from said neck when said ring is held against rotation, and holding means for engaging said container so as to prevent rotation of said ring, said holding means being located on said ring, extending inwardly from said ring, and for engaging said container neck so as to deform said material in said neck into conformity with the configuration of said holding means in order to secure said ring against movement relative to said neck so that the action of said ratchet means will prevent said closure from being unthreaded from said neck, coacting means on said closure and on said ring for distorting said ring so as to force said holding means on said ring inwardly into said engagement with said container neck as said closure is threaded on said neck, said closure being located on said neck in a position in which said ratchet means are engaged with one another and in which said coacting means are in engagement with one another so as to hold said holding means in said engagement with said container neck.

2. The combination claimed in claim 1 wherein: said holding means comprise a plurality of ridges supported by said ring, said ridges being in engagement with said neck.

3. The combination claimed in claim 1 wherein:

said means for distorting said ring inwardly comprise said closure and said ring ratchet means, said closure and said ring ratchet means being oriented so that said closure exerts an inwardly directed force against said ring ratchet means so as to force said holding means into engagement with said container.

4. The combination claimed in claim 1 wherein:

said ring carries a plurality of fingers spaced from one another around said neck, said fingers being capable of being pivoted relative to said ring, said ring ratchet means comprise ratchet surfaces on said fingers, said holding means comprising ridges on said fingers.

5. The combination claimed in claim 4 wherein:

said closure and ring ratchet means are oriented so as to apply an inwardly directed force against said fingers so as to hold said ridges in contact with said neck.

* * * * *

UNITED STATES PATENT OFFICE
CERTIFICATE OF CORRECTION

PATENT NO. : 3,977,557

DATED : AUGUST 31, 1976

INVENTOR(S) : ROBERT E. HAZARD

It is certified that error appears in the above-identified patent and that said Letters Patent are hereby corrected as shown below:

Column 3, line 49, "fingers 26 inwardly" should read --fingers 26 outwardly--.

Column 5, line 56, "container 10", second occurrence, should read --container 100--.

Signed and Sealed this

Seventh Day of December 1976

[SEAL]

*Attest:*

RUTH C. MASON
*Attesting Officer*

C. MARSHALL DANN
*Commissioner of Patents and Trademarks*